United States Patent [19]

Kawakami

[11] 4,302,955

[45] Dec. 1, 1981

[54] BICYCLE LOCK

[76] Inventor: Shigeru Kawakami, 17-3 Higashi Shinkoiwa 6-chome, Katsushika, Tokyo, Japan

[21] Appl. No.: 111,334

[22] Filed: Jan. 11, 1980

[30] Foreign Application Priority Data

Apr. 4, 1979 [JP] Japan ..... 54-39686

[51] Int. Cl.[3] ..... E05B 37/08

[52] U.S. Cl. ..... 70/30; 70/303 R

[58] Field of Search ..... 70/23, 30, 302, 303 R, 70/18

[56] References Cited

U.S. PATENT DOCUMENTS

| | | | |
|---|---|---|---|
| 200,617 | 2/1878 | King | 70/30 |
| 1,468,027 | 9/1923 | Lindberg | 70/302 |
| 3,999,408 | 12/1976 | Kawakami | 70/18 |

*Primary Examiner*—Robert L. Wolfe

*Attorney, Agent, or Firm*—Gifford, VanOphem, Sheridan & Sprinkle

[57] ABSTRACT

A combination lock and a length of steel cable of chain connected with the ends of said lock is disclosed. The lock comprises a bolt inserted in a casing having a shaft unrotatably disposed therein. Adjacent to one end of the shaft, a knob is mounted. Three step wheels, each having a peripheral recess, are also loosely mounted on the shaft. The step wheels are provided with a projection or projections on one or both sides for transmitting the movements of the knob. Adjacent to the first step wheel which is farthest from the knob, a retaining wheel is mounted on the shaft. The retaining wheel is provided with a recess at its periphery and a projection at one side. The projection is inserted in either one of five recesses provided at one side of the first step wheel whereby five different code numbers will be obtained without changing the step wheels. A click mechanism is arranged between the shaft and the knob. Adjacent to the retaining wheel, a retainer of an inverted "C" form having laterally extending end portions is slidably mounted across the shaft. In the locked state, the inner end portion of the retainer engages with the recess of the retaining wheel while the outer end portion protrudes from the casing by the action of a spring whereby the knob can not be turned. This lock has no numeral indicating means and is unlocked by listening to clicking sounds.

1 Claim, 19 Drawing Figures

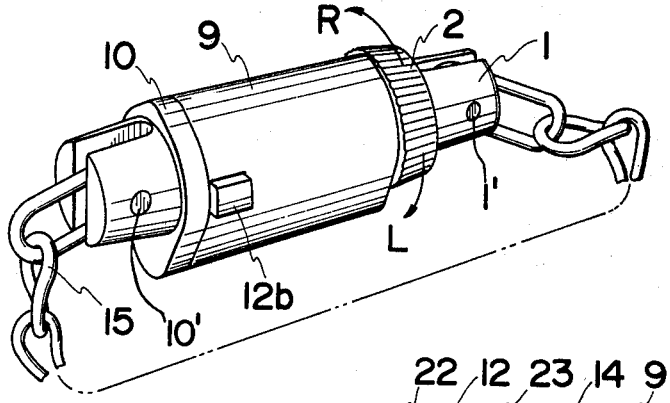
FIG. 1
FIG. 2
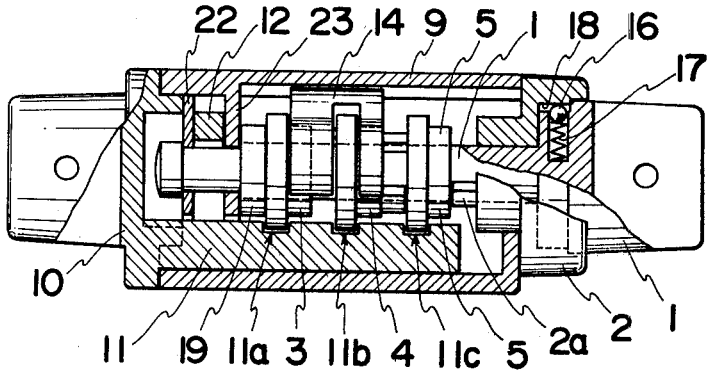
FIG. 3A
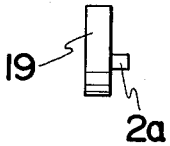
FIG. 3B
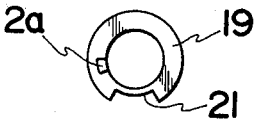
FIG. 4A
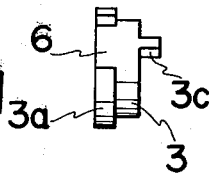
FIG. 4B
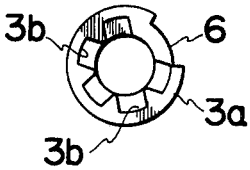
FIG. 4C
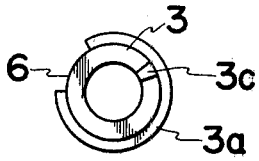
FIG. 5A
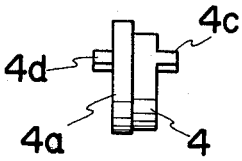
FIG. 5B
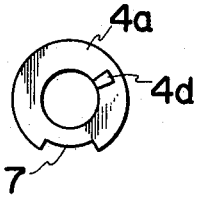
FIG. 5C
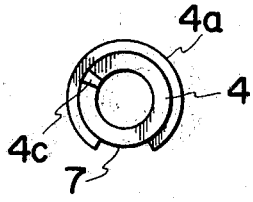

BICYCLE LOCK

FIELD OF THE INVENTION

This invention relates to a bicycle lock consisting of a combination lock and a length of steel cable or chain connected with the ends of said lock.

SUMMARY OF THE INVENTION

The combination lock employed herein is novel in its construction. A shaft is unrotatively arranged within the casing of the lock. Adjacent to one end of the shaft, a knob is rotatably mounted. Between the knob and the shaft, a well known click mechanism consisting of a ball and a spring is placed.

Three step wheels, each having a recess in its periphery, are loosely mounted on the shaft. Adjacent to the first step wheel which is farthest from the knob, a retaining wheel having a recess in its periphery, is loosely mounted on the shaft and is rotatable with the first step wheel. Further, adjacent to said retaining wheel, a retainer of an inverted "C" form is mounted slidably across the shaft. The retainer is provided with laterally extended ends. The outer end of thereof juts from the casing.

The lock bolt inserted in the casing is provided with three notches each corresponding to one of the step wheels. In the locking position, all the step wheels engage with notches and the inner end of the retainer engages with the recess provided in the periphery of the retaining wheel so that the knob can rotate no more and the outer end of the retainer projects fully from the casing.

To unlock, one must first push the outer end of the retainer projecting from the casing inward so as to release the retaining wheel, then the knob is first turned clockwise until the number of click sounds coinciding the first numeral of the code number are heard, whereby the first step wheel which is farthest from the knob is brought to the release position wherein its peripheral recess lies just above the corresponding notch of the locking bolt. Next, the knob is turned counterclockwise until click sounds coinciding with the second numeral of the code number are heard whereby the second step wheel is brought to the release position wherein its peripheral recess lies just above the corresponding notch of the locking bolt. Finally the knob is turned again clockwise until click sounds coinciding with the final numeral of the code number are heard whereby the third step wheel adjacent to the knob is brought to the release position wherein its peripheral recess lies just above the corresponding notch of the bolt. The as all step wheels disengage from the notches of the bolt, the bolt may be withdrawn from the casing.

As is clear from the above, numerals of the code number are indicated by number of click sounds, the lock of this invention can be unlocked in the dark by listening click sounds.

BRIEF DESCRIPTION OF THE DRAWINGS

The diverse purposes and advantages of the invention and a better understanding thereof may be had by reference to the following description, taken in conjunction with the accompanying drawing, in which:

FIG. 1 is a perspective view of the bicycle lock of the present invention;

FIG. 2 is a longitudinal sectional view thereof in the locked state;

FIG. 3A is a side view of the retaining wheel; and

FIG. 3B is a front view of the retaining wheel;

FIG. 4A is a side view of the first step wheel;

FIG. 4B is a front view of the first step wheel; and

FIG. 4C is a rear view of the first step wheel;

FIG. 5A is a side view of the second step wheel;

FIG. 5B is a front view of the second step wheel; and

FIG. 5C is a rear view of the second step wheel;

DESCRIPTION OF A PREFERRED EMBODIMENT

Figure 6A:
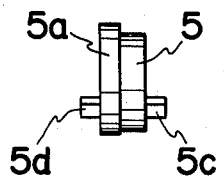
FIG. 6A is a side view of the third step wheel.

As illustrated in the drawings, and more particularly at FIGS. 1 and 2, the lock of the invention comprises a tubular casing 9 having an end provided with a rotatable knob 2, while the other end of the casing is provided with a detachable cap 10. The knob is rotatably mounted on one end of the shaft 1 which is unrotatably supported in the casing 9. A ball 16 and a spring 17 arranged between the knob 2 and the shaft 1 constitute a well known click mechanism to assure each rotating position of the knob 2.

On the shaft 1, three step wheels, namely first step wheel 3*a*, second step wheel 4*a* and third step wheel 5*a* are loosely mounted. Each step wheel is provided with a recess in its periphery.

Figure 6B:
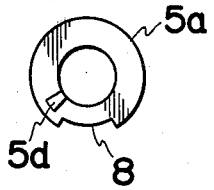
FIG. 6B is a front view of the third step wheel.
Figure 6C:
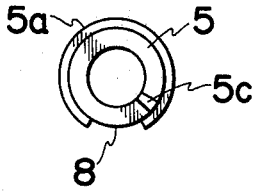
FIG. 6C is a rear view of the third step wheel.

The first step wheel 3*a*, as shown in FIGS. 4A–4C, which is farthest from the knob 2 is provided with a recess 6 at its periphery and its flange member 3 is provided with a projection 3*c*. Further, its front is provided with five recesses 3*b*. The second step wheel 4*a*, as shown in FIGS. 5A–5C is provided with a recess 7 in its periphery and its flange member 4 as well as one side of the step wheel are provided with projections 4*c* and 4*d* respectively. The third step wheel 5*a*, as shown in FIGS. 6A–6C, which is adjacent to the knob 2, is provided with a recess 8 in its periphery, and its flange member 5 and one side of the step wheel is provided with projections 5*c* and 5*d* respectively.

The retaining wheel 19, as shown in FIGS. 3A–3B, is loosely or slidably mounted on the shaft 1 adjacent to the first step wheel 3*a*. The retaining wheel 19 is provided with a recess 21 in its periphery and a projection 2*a* at one side. The projection 2*a* is inserted into either one of the five recesses 3*b* of the first step wheel 3*a* so as to obtain five different code numbers without changing any of the step wheels.

Figure 9A:
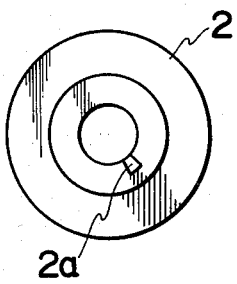
FIG. 9A is a front view of the knob.
Figure 9B:
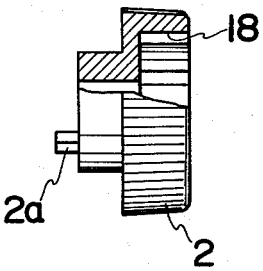
FIG. 9B is a side view of the knob.
Figure 9C:
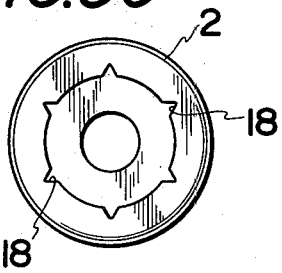
FIG. 9C is a rear view of the knob.

The knob 2, as shown in FIGS. 9A–9C, is provided with a projection 2*a* at one side and six recesses 18 arranged circularly at the other side.

The movement of the knob 2 is transmitted to the third step wheel 4*a* through the engagement of the projection 2*a* of the knob 2 and the projection 5*c* of the third step wheel 5*a*. The movement of the third step wheel 5*a* is transmitted to the second step wheel 4*a* through the engagement of the projection 5*d* of the third step wheel 5*a* and the projection 4*c* of the second step wheel 4*a*. The movement of the second step wheel 4*a* is transmitted to the first step wheel 3*a* and the retaining wheel 19 through the engagement of the projection 4*d* of the second step wheel 4*a* and the projection 3*c* of the first step wheel 3*a*.

Figure 8A:
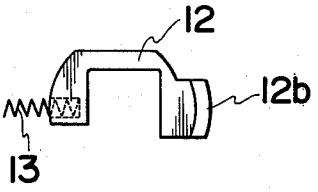
FIG. 8A is a side view of the retainer.
Figure 8B:
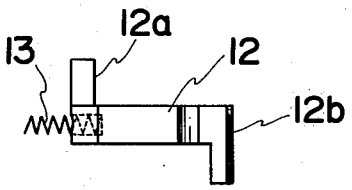
FIG. 8B is a plan view of the retainer.

Adjacent to the retaining wheel, 19 a retainer 12 of an inverted "C" form, as shown in FIGS. 8A–8B, is slidably placed across the shaft 1 between partition walls 22 and 23. The retainer 12 is provided with laterally extended end portions 12*a* and 12*b*. The outer end portion 12*b* partially juts from the casing 9 as shown in FIG. 1. The retainer 12 tends to slide outward by the action of a spring 13. The inner end portion 12*a* engages with the recess 21 of the retaining wheel 19 at the locked state of the lock.

Figure 7:
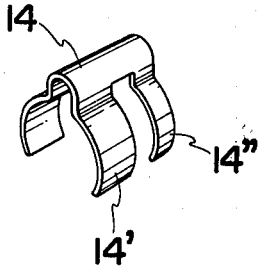
FIG. 7 illustrates a double clip.

A double clip, as shown in FIG. 7, is employed to prevent unwanted movements of the first and the second step wheels 3*a* and 4*a* respectively. The double clip is composed of two clip members 14' and 14''. The joint of the double clip is inserted in a longitudinal groove formed in the inner surface of the casing 9. The clip members 14' and 14'', resiliently and frictionally engage with the flange members 3 and 4 respectively of the first and the second step wheels 3*a* and 4*a* respectively.

The cap 10 is secured to, or integral with, one end of a bolt 11. As shown in FIG. 2, the bolt 11 is provided with three notches 11*a*, 11*b* and 11*c* which engage with portions of the peripheries of the step wheels 3*a*, 4*a* and 5*a*, respectively, in the locking position.

A length of steel cable or chain 15 is connected to connecting members 1' and 10' whereby the cable or chain and the lock form a loop when said lock is in the locked position. The connecting members 1' and 10' are formed on one body with the shaft 1 and cap 10, respectively.

The operation of the bicycle lock may now be described, assuming the code number is [2]-[6]-[4], for example.

For unlocking, first push the end portion 12*b* which is projecting from the casing 9 inward with a finger against the action of the spring 13 so as to release the retaining wheel 19 by disengaging the end portion 12*a* from the recess 21 of the retaining wheel 19. Then, the knob 2 is turned in a clockwise direction until two click sounds are heard. Pushing on the end portion 12*b* is no longer necessary. The movement of the knob 2 is transmitted to the first step wheel 3*a* and the retaining wheel 19 through the engagement on the projections 2*a* and 5*c*, 5*d* and 4*c*, and 4*d* and 3*c* in succession and the first step wheel 3*a* is brought to the position wherein its recess 6 is located just above the notch 11*a* provided in the bolt 11.

Next, the knob 2 is turned in a counter-clockwise direction until six click sounds are heard whereby the movement of the knob 2 is transmitted to the second step wheel 4*a* through the cooperation of the projections 2*a*, 5*c*, 5*d* and 4*c* so as to bring the second step wheel 4*a* to the position wherein its recess 7 lies just above the notch 11*b* provided on the bolt 11.

Finally, the knob 2 is turned in a clockwise direction again until four click sounds are heard whereby the movement of the knob 2 is transmitted to the third step wheel 5*a* through the engagement of the projections 2*a* and 5*c* and the third step wheel 5*a* is brought to the position wherein its recess 8 lies just above the notch 11*c* provided on the bolt 11. Thus, all the recesses provided in the peripheries of three step wheels are brought one by one above the corresponding notches of the bolt 11, whereby the bolt is released from the grips of the step wheels and may be withdrawn from the casing 9.

In order to lock the device, after the steel cable or chain 15 is led around the rim of the front wheel and the front fork of a bicycle, and a post or the like, the bolt 11 is inserted in the casing 9 and the knob 2 is turned clockwise until the end portion 12*b* projects fully from the casing 9 so as immobilize the knob 2.

As is clear from the above description, the bicycle lock of this invention can be unlocked by turning the knob 2 first in one direction, next in an opposite direction and finally in the same direction as the first and simultaneously listening number of click sounds coinciding with the code number. Thus, this lock can be unlocked in the dark.

Although the present invention has been described as consisting of three step wheels, thereby providing a code number consisting of three digits, it will be readily apparent that only two step wheels could be used, thus providing for a two-digit code number, or more than three step wheels could be used, thus providing for a multi-digit code number.

Having thus described the present invention by way of a typical preferred embodiment thereof, what is claimed is:

1. A bicycle lock comprising:

a casing having a hole;

a retainer mounted adjacent said casing, said retainer having a one end portion projecting into said hole of said casing;

a shaft unrotatably supported in said hole of said casing;

a knob slidably mounted adjacent to the one end of said shaft;

at least one pair of step wheels slidably mounted on said shaft, each of said at least one pair of step wheels having a recess in its periphery, a reduced diameter cylindrical lateral flange adjacent said recess in its periphery, and a plurality of axial recesses formed in the face of said reduced diameter cylindrical lateral flange;

a retaining wheel slidably mounted on said shaft, said retaining wheel having a projection on one side engaging at least one of said plurality of axial recesses in one of said at least one pair of step wheels;

a clip disposed within said casing for preventing accidental movements of said at least one pair of step wheels, said clip having at least one clip member in frictional peripheral engagement with said lateral flange of the other of said at least one pair of step wheels;

a retainer slidably mounted adjacent to said retaining wheel, said retainer having a pair of laterally extending end portions, one of said pair of laterally extending end portions further engaging at least one of said plurality of axial recesses in said retaining wheel while the other of said pair of laterally extending end portions further projects outward from said hole in said casing;

a locking bolt inserted in said casing, said locking bolt having a plurality of notches corresponding with said peripheral recesses in said at least one pair of step wheels and a cap at one end;

a length of chain having one end connected to said cap and an opposite end connected to said knob; and means for transmitting the rotation of said knob to each of said pair of step wheels, said transmitting means further comprising:

a laterial projection on at least one side of each of said pair of step wheels, each of said lateral projections on one of said step wheels further being engageable with said lateral projection on one side of the other of said pair of step wheels.

* * * * *

UNITED STATES PATENT AND TRADEMARK OFFICE

CERTIFICATE OF CORRECTION

PATENT NO. : 4,302,955

DATED : December 1, 1981

INVENTOR(S) : Shigeru Kawakami

It is certified that error appears in the above-identified patent and that said Letters Patent are hereby corrected as shown below:

In the Abstract, line 22, delete "can not" and insert --cannot-- therefor.

Column 1, line 54, delete "The" and insert --Thus-- therefor.

Column 1, line 60, after "listening", insert --to--.

Column 4, line 4, after "as", insert --to--.

Column 4, line 9, after "listening", insert --to a--.

Signed and Sealed this

Sixteenth Day of March 1982

[SEAL]

Attest:

GERALD J. MOSSINGHOFF

Attesting Officer

Commissioner of Patents and Trademarks